US006238620B1

(12) United States Patent
Liu et al.

(10) Patent No.: US 6,238,620 B1
(45) Date of Patent: May 29, 2001

(54) $NI_3AL$-BASED ALLOYS FOR DIE AND TOOL APPLICATION

(75) Inventors: Chain T. Liu, Oak Ridge; Everett E. Bloom, Kingston, both of TN (US)

(73) Assignee: U.T.Battelle, LLC, Oak Ridge, TN (US)

( * ) Notice: Subject to any disclaimer, the term of this patent is extended or adjusted under 35 U.S.C. 154(b) by 0 days.

(21) Appl. No.: 09/396,957

(22) Filed: Sep. 15, 1999

(51) Int. Cl.[7] ..... C22C 19/05

(52) U.S. Cl. ..... 420/449; 420/450; 420/460; 148/429

(58) Field of Search ..... 420/449, 450, 420/460; 148/429

(56) References Cited

U.S. PATENT DOCUMENTS 3,615,376 * 10/1971 Ross ..... 75/171
3,642,469 * 2/1972 Ross et al. ..... 75/171
3,902,900 * 9/1975 Restall et al. ..... 75/171
3,922,168 * 11/1975 Restall et al. ..... 75/171
4,710,247 * 12/1987 Huang et al. ..... 148/429
4,711,761 12/1987 Liu et al. ..... 420/459
4,727,740 * 3/1988 Yabuki et al. ..... 72/209
4,731,221 * 3/1988 Liu ..... 420/445
5,006,308 * 4/1991 Liu et al. ..... 420/445
5,108,700 * 4/1992 Liu ..... 420/445
5,167,732 * 12/1992 Naik ..... 148/404
6,033,498 * 3/2000 Chen et al. ..... 148/555
6,066,291 * 5/2000 Chen et al. ..... 420/445

* cited by examiner

*Primary Examiner*—Roy V. King
*Assistant Examiner*—Nicole Coy
(74) *Attorney, Agent, or Firm*—Hardaway/Mann IP Group

(57) ABSTRACT

A novel $Ni_3Al$-based alloy exhibits strengths and hardness in excess of the standard base alloy IC-221M at temperatures of up to about 1000° C. The alloy is useful in tool and die applications requiring such temperatures, and for structural elements in engineering systems exposed to such temperatures.

11 Claims, 5 Drawing Sheets

$NI_3AL$-BASED ALLOYS FOR DIE AND TOOL APPLICATION

STATEMENT OF GOVERNMENT RIGHTS

The United States Government has rights in this invention according to the terms of Contract Number DE-AC05-96OR22464 between Lockheed Martin Energy Research Corporation and the United States Department of Energy.

FIELD OF THE INVENTION

The invention relates generally to the field of $Ni_3Al$-based alloys. More particularly, the invention relates to alloys exhibiting superior strength and hardness characteristics at ambient and elevated temperatures, the alloys thus showing improved utility for high-temperature die and tool applications, and applications in structures and machinery exposed to high-temperature environments.

BACKGROUND OF THE INVENTION

Non-ferrous, intermetallic alloys based on tri-nickel aluminide ($Ni_3Al$ alloys) possess many properties making them useful for applications involving elevated temperatures. A primary reason for this is the characteristic of these alloys that, contrary to the behavior of conventional alloys, the yield strength of the alloys increases with increasing temperatures. Thus, where yield strength is important in high temperature applications, these alloys are often the preferred material.

To take advantage of this important characteristic of nickel aluminide alloys, many attempts have been made to adapt base alloys to special uses. A specialized alloy designed to improve fabricable materials was proposed in U.S. Pat. No. 4,711,761, assigned to Martin Marietta Energy Systems, Inc. The proposed alloy contained iron for increased yield strength and contained titanium, manganese, and niobium for improved cold fabricability. Iron-containing nickel aluminide alloys have been proposed also containing hafnium and zirconium for improved strength.

Iron containing and some non-ferrous base alloys exhibited brittleness at higher temperatures, however, especially in an oxygen bearing environment. Other problems with existing alloys were pointed out in U.S. Pat. No. 5,006,308. This patent proposed a non-ferrous alloy in which the base alloy was compounded with chromium, zirconium, and boron.

Attempts have also been made to produce castable nickel aluminide alloys for applications in such apparatus as turbocharger rotors. For applications such as this, the yield strength at room temperatures (about 25° C.) is required to be above about 80 ksi (ksi=1,000-lb per square inch≅6.97 MPa). Known alloys were only marginally acceptable. An alloy having improved yield strength at this temperature was proposed in U.S. Pat. No. 5,108,700, in which defined amounts of chromium, zirconium, boron, and either or both of molybdenum and niobium were present.

Castable alloys still have significant drawbacks. A recognized $Ni_3Al$ alloy for structural use at both ambient and high temperatures in hostile environments is one designated as IC-221M. This alloy has a composition of, by atomic percent, 15.9 aluminum; 8.0 chromium; 0.8 molybdenum; 1.0 zirconium; and 0.04 boron. This alloy has many attractive qualities, including good strength, oxidation resistance, and wear resistance at elevated temperatures.

This alloy has become a standard for advanced material for use in die and tool applications, that is, hot forging.

Despite its current use commercially, however, this alloy exhibits significant reductions in strength at temperatures in excess of about 800° C. This limits its usefulness in both structural applications and tool and die applications requiring or existing in higher temperatures. Additionally, and especially in stamping and tooling operations, increased hardness would improve not only the use in existing applications but enable use in other applications as well.

SUMMARY OF THE INVENTION

It is therefore an object of this invention to provide a non-ferrous alloy capable of extended use in hostile environments at both ambient and elevated temperatures.

It is also an object of this invention to provide a nickel-aluminide alloy exhibiting high yield and ultimate strengths at ambient and elevated temperatures.

It is a further object of this invention to provide an alloy that has the characteristics of good oxidation and wear resistances at temperatures including about 1000° C.

It is another object of this invention to provide an improved alloy having greater strength and hardness than IC-221M.

It is likewise an object of this invention to provide a nickel aluminide alloy wherein carbides are formed to increase the hardness and strength of the alloy.

It is moreover an object of this invention to provide a nickel aluminide alloy exhibiting increased grain boundary strength.

These and other objects are achieved by providing a $Ni_3Al$-based alloy comprising chromium, molybdenum, zirconium, titanium, carbon, and boron, said alloy, in comparison to IC-221M, having about 16% higher strength at temperatures ranging from about 25 to about 1000 degrees C. and having a hardness at room temperature about 14% higher than said IC-221M. These and other advantages are achieved by providing an alloy comprising, by atomic percent, about 15–17% aluminum; about 6–9% chromium; about 1.5–3.0% molybdenum; about 0.2–1% zirconium; about 0.5–1.5% titanium; about 1–2% carbon; and about 0.01–0.1% boron; with the balance being nickel.

DETAILED DESCRIPTION OF THE INVENTION

Figure 1B:
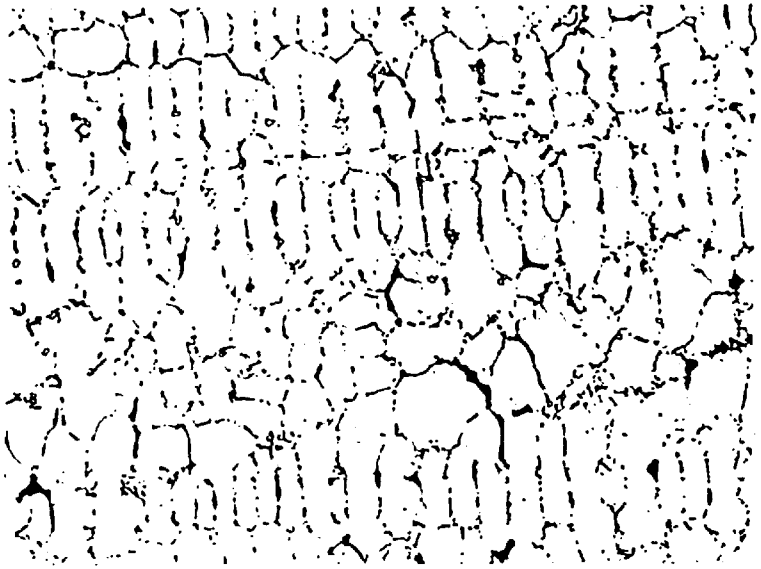
FIG. 1 is a series of optical micrographs showing the structure of the base alloy IC-221M with varying amounts of titanium and carbon added, at a magnification of 250X.

The alloy compositions of the current invention are derived from the base alloy tri-nickel aluminide, $Ni_3Al$, a polycrystalline intermetallic alloy. From the prior art, it is known that the addition of chromium to the base alloy improves ductility and strength of the alloy at both room and elevated temperatures. Too high a concentration of chromium, however, above about 10%, results in decreased ductility at room temperature. (All percentages herein, unless otherwise noted, are given as atomic percents.) Too little chromium, below about 6%, was reported to cause low ductility at temperatures of about 800° C.

The addition to the base alloy of up to about 2.0% titanium improves the yield strength of cast products. Molybdenum in defined amounts also improves strength and enhances the creep resistance of the alloy in its cast condition. Finally, boron is added in relatively small amounts to improve ductility. The currently used alloy designated as IC-221M, the formula of which is given above, incorporates chromium, molybdenum, zirconium, and boron. This alloy does not, however, contain titanium.

Many processes, especially including tool and die applications, but also including structural applications, take place at or are exposed to very high temperatures. The IC-221M exhibits good strength and oxidation resistance to a certain point. Above temperatures of about 800° C., however, the strength of this alloy decreases significantly. Therefore, alloys retaining substantial strength and resistance at higher temperatures are needed for certain applications. Such alloys will have wide applicability if the improved characteristics are also present at lower temperatures.

Series of experiments were undertaken to discover and optimize an alloy having the desired strength and hardness at higher temperatures. The experimental work is described immediately below, followed by a discussion of results. As used herein, unless otherwise noted, the term base alloy refers to that composition designated as IC-221M, the formula of which is given above and in Table 1 below.

Three series of alloys were prepared. The experimental alloys were formed by arc melting, and were drop cast into copper molds. The molds formed rectangular ingots weighing about 500 g., having dimensions of 1.0×0.5×1.0 inches (25.4×12.9×25.4 mm). Table 1 lists the compositions of the experimental alloys. These alloys can be also prepared by induction melting and casting and other techniques commonly used for processing of metallic alloys.

TABLE 1

Alloy Compositions of $Ni_3Al$-Based Alloy

| Alloy No. | Composition (at. %)* | Hardness RC |
|---|---|---|
| | First Series | |
| IC-221M | 15.9Al-8Cr-1Zr-0.8Mo-0.04B | 34.2 |
| IC-451 | 15.8Al-7.9Cr-1Zr-0.45Ti-0.8Mo-0.45C-0.04B | 35.3 |
| IC-452 | 15.7Al-7.9Cr-1Zr-0.88Ti-0.8Mo-0.88C-0.04B | 34.5 |
| IC-453 | 15.6Al-7.8Cr-1Zr-1.7Ti-0.8Mo-1.7C-0.04B | 35.6 |
| IC-454 | 15.5Al-7.8Cr-1Zr-2.6Ti-0.8Mo-2.6C-0.04B | 34.4 |
| | Second Series | |
| IC-455 | 15.6Al-7.9Cr-1Zr-1.7Ti-0.8Mo-1.25C-0.5B | 36 |
| IC-456 | 15.6Al-7.9Ct-1Zr-1.1Ti-0.8Mo-1.25C-0.5B | 37.2 |
| IC-457 | 15.9Al-8Cr-1Zr-0.8Mo-1.7C | 35.3 |
| IC-458 | 15.9Al-8Cr-1Z-0.8Mo-1.35C-0.5B | 36.7 |
| | Third Series | |
| IC-459 | 15.6Al-8Cr-1Zr-1.1Ti-1.5Mo-1.7C-0.05B | 37.2 |
| IC-460 | 15.6Al-8Cr-0.8Zr-1.0Ti-2.5Mo-1.7C-0.05B | 39.1 |
| IC-461 | 15.6Al-8Cr-0.8Zr-1.0Ti-2.5Mo-1.25C-0.15B | 38.8 |

*Balanced with Ni.

The first series of alloys were derived directly from the base alloy. Titanium and carbon were added in equal measures to each alloy in the series at levels varying from about 0.45% to about 2.6%.

Tensile sheet specimens were prepared by electro-discharge machining. The specimens had a gage dimension of 0.142×0.032×0.5 inches (3.5×0.81×12.9 mm). The specimens were polished with SiC papers. Tensile characteristics were measured with an Instron testing machine at temperatures ranging up to 1000° C. at a cross-head speed of 0.1 inches per minute (2.54 mm per minute). The results of these tests are shown in Table 2.

TABLE 2

Tensile Properties of First Series of $Ni_3Al$-Based Alloys

| Alloy Number | Strength (ksi) Yield | Strength (ksi) Ultimate | Elongation (%) |
|---|---|---|---|
| | Room Temperature | | |
| IC-221M | 95.1 | 163 | 36.5 |
| IC-451 | 97.2 | 112 | 8.3 |
| IC-452 | 104.0 | 137 | 12.2 |
| IC-453 | 112.0 | 135 | 8.7 |
| IC-454 | 95.2 | 117 | 9.3 |
| | 600° C. | | |
| IC-221M | 101 | 144 | 32.4 |
| IC-451 | | | |
| IC-452 | 106 | 125 | 14.8 |
| IC-453 | 112 | 134 | 6.8 |
| IC-454 | | | |
| | 850° C. | | |
| IC-221M | 102 | 116 | 16.8 |
| IC-451 | 104 | 114 | 11.6 |
| IC-452 | 104 | 118 | 7.2 |
| IC-453 | 106 | 120 | 3.7 |
| IC-454 | 118 | 127 | 3.5 |
| | 1000° C. | | |
| IC-221M | 58.1 | 61.0 | 13.4 |
| IC-451 | | | |
| IC-452 | 64.2 | 70.6 | 7.4 |
| IC-453 | 72.2 | 80.3 | 6.8 |
| IC-454 | | | |

The testing of the first series of experimental alloys indicated that the species designated as IC-453 had the best tensile properties. The second series of experimental alloys were designed to test two factors. First, it was determined to replace a portion of the carbon in IC-453 with boron to modify the carbide structures. The experimental alloys IC-455 and IC-456 thus were formed with about 0.5% boron replacing some of the carbon. Two alloys, IC-457 and IC-458, were formed without titanium to test the effect of alloys having both carbides and borides. The compositions of these are also set out in Table 1 above.

This second series of alloys were prepared as described above, and the tensile properties were also tested as described above. Table 3 shows the results of these tests.

TABLE 3

Tensile Properties of Second Series of $Ni_3Al$-Based Alloys

| Alloy Number | Strength (ksi) Yield | Strength (ksi) Ultimate | Elongation (%) |
|---|---|---|---|
| | Room Temperature | | |
| IC-221M | 95.1 | 163 | 36.5 |
| IC-455 | 101 | 138 | 15.1 |
| IC-456 | 104 | 147 | 15.8 |
| IC-457 | 107 | 136 | 10.0 |
| IC-458 | 104 | 145 | 15.1 |

TABLE 3-continued

Tensile Properties of Second Series of $Ni_3Al$-Based Alloys

| Alloy Number | Strength (ksi) Yield | Ultimate | Elongation (%) |
|---|---|---|---|
| | 600° C. | | |
| IC-221M | 101 | 144 | 32.4 |
| IC-455 | 108 | 128 | 9.5 |
| IC-456 | | | |
| IC-457 | | | |
| IC-458 | 111 | 136 | 9.2 |
| | 850° C. | | |
| IC-221M | 106 | 123 | 9.8 |
| IC-455 | 109 | 124 | 6.0 |
| IC-456 | 113 | 129 | 4.5 |
| IC-457 | 99.1 | 112 | 6.3 |
| IC-458 | 112 | 125 | 6.3 |
| | 1000° C. | | |
| IC-221M | 58.1 | 61 | 13.4 |
| IC-455 | 69.5 | 76.6 | 6.4 |
| IC-456 | | | |
| IC-457 | | | |
| IC-458 | 60.0 | 63.7 | 13.2 |

A third series of experimental alloys was prepared. In this case, it was determined to improve the characteristics of the alloys by both solid solution hardening and carbide strengthening. Additional molybdenum was added to the alloy IC-453. Formation and tensile testing proceeded as described above. Table 4 shows the tensile properties of the series, the compositions of which are recorded in Table 1.

TABLE 4

Tensile Properties of Third Series of $Ni_3Al$-Based Alloys

| Alloy Number | Strength (ksi) Yield | Ultimate | Elongation (%) |
|---|---|---|---|
| | Room Temperature | | |
| IC-221M | 95.1 | 163 | 36.5 |
| IC-459 | 102 | 137 | 12.8 |
| IC-460 | 110 | 140 | 10.0 |
| IC-461 | 106 | 147 | 18.4 |
| | 600° C. | | |
| IC-221M | 101 | 144 | 32.4 |
| IC-459 | 107 | 120 | 4.0 |
| IC-460 | 108 | 132 | 8.5 |
| IC-461 | 113 | 127 | 4.0 |
| | 800° C. | | |
| IC-221M | 106 | 123 | 9.8 |
| IC-459 | 110 | 120 | 2.5 |
| IC-460 | 119 | 138 | 5.7 |
| IC-461 | 125 | 137 | 3.1 |
| | 1000° C. | | |
| IC-221M | 58.1 | 61.0 | 13.4 |
| IC-459 | 62.5 | 72.2 | 11.4 |
| IC-460 | 70.0 | 75.9 | 9.1 |
| IC-461 | 79.5 | 84.9 | 6.8 |

Optical micrographs were prepared. All of the experimental alloys were tested for hardness. A Buehler microhardness tester was used at room temperature. The hardness $R_c$ for each alloy is recorded in Table 1.

The results are described with reference to the figures herein. The addition of titanium and carbon to the base alloy caused the formation of carbides. The results of varying concentrations are shown in the optical micrographs in FIG. 1. In micrograph (a) is shown the base alloy. Micrograph (b) is the base alloy with the addition of equal amounts (1.76%) of carbon and titanium. This is the experimental alloy designated IC-453. Micrograph (c) shows the base alloy also with equal amounts of carbon and titanium added, this time in a higher concentration of 2.6%.

Figure 1A:
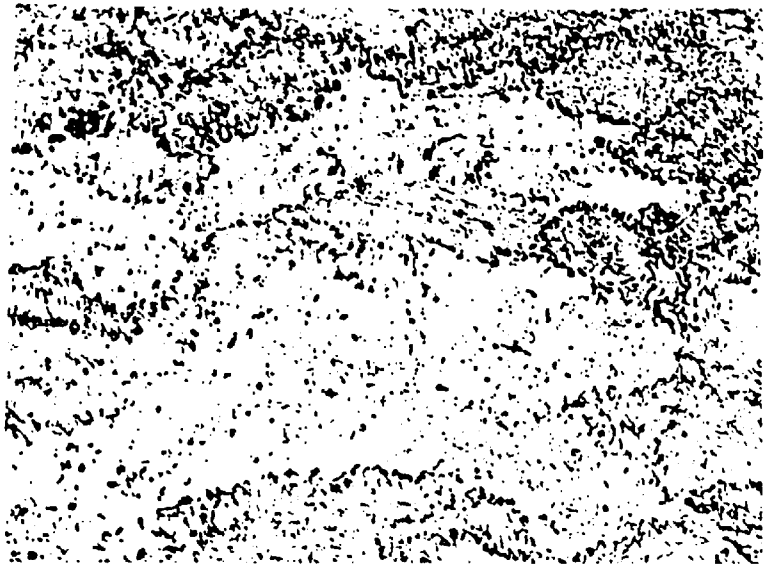
Figure 1C:
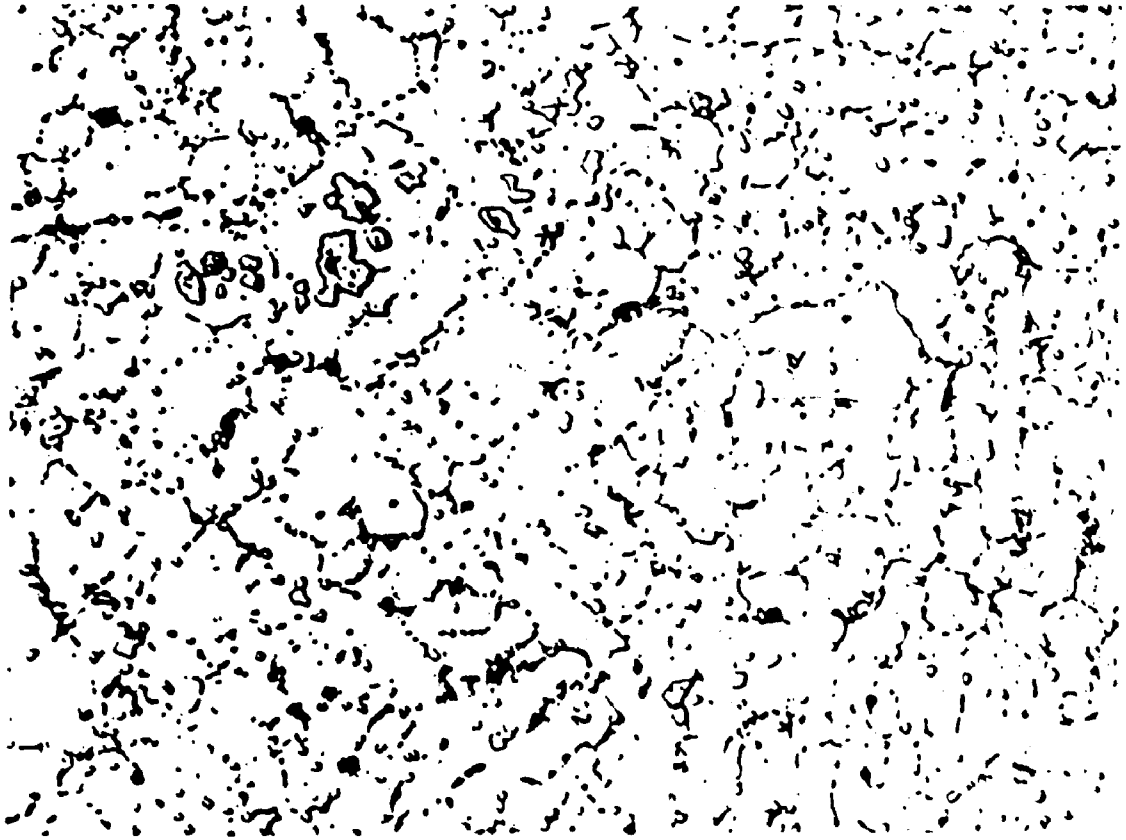
Figure 3:
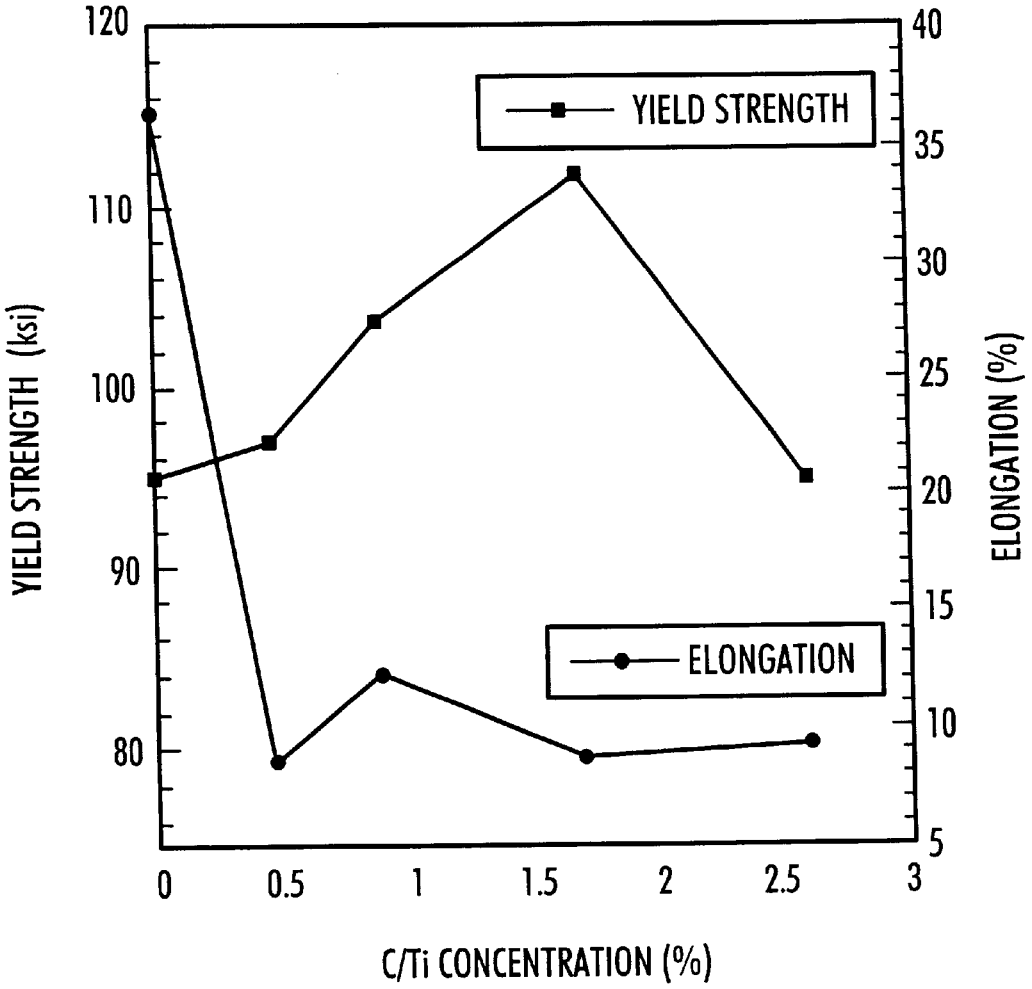
FIG. 3 is a plot of room-temperature yield strength and elongation characteristics of nickel aluminide alloys as a function of the carbon/titanium concentration.

Micrograph (b) of FIG. 1 shows that at the lower (1.76%) concentration, fine carbide particles are formed. These appear mainly at refined dendritic boundaries. Raising the concentration above about 2.0%, however, causes the formation of coarse carbide particles within dendritic grains. These results are shown in the plot set forth as FIG. 3, charting both yield strength and elongation as a function of the carbon/titanium (C/Ti) concentration. The plot shows that yield strength increased with increasing C/Ti concentration until the concentration approached about 2.0%. Thereafter, it fell. Conversely, elongation percent fell until about the same point, after which it leveled off to remain relatively constant.

Figure 2B:
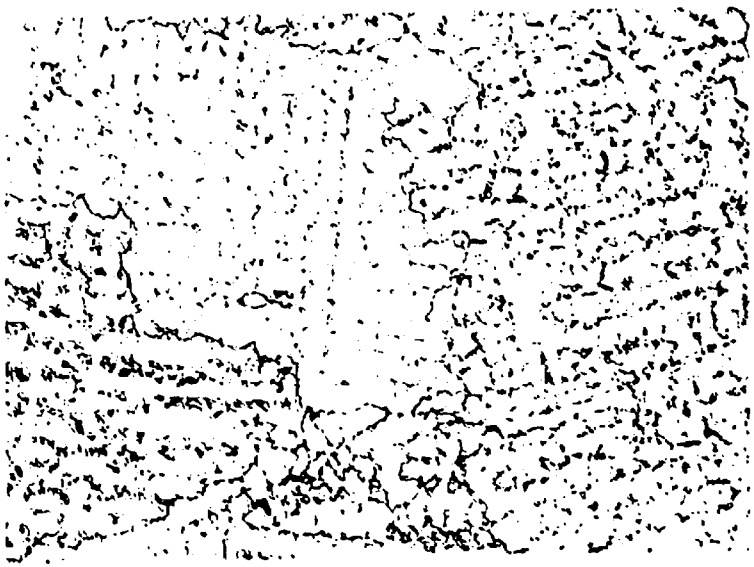
FIG. 2 is a comparison of optical micrographs of (a) base alloy IC-221M and (b) the alloy of the current invention, both at a magnification of 250X.
Figure 2A:
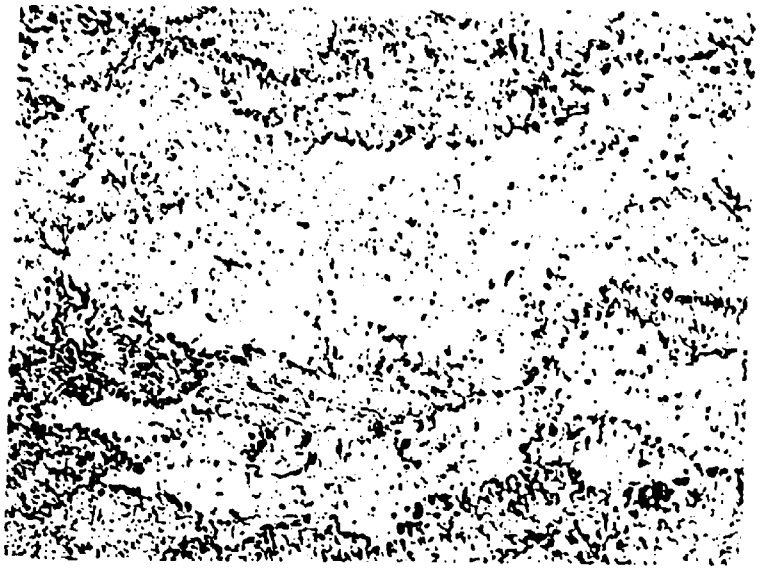

The third series, and specifically the alloy designated IC-460, showed the best results. By increasing the amount of molybdenum over that found in the base alloy, and adding titanium and carbon, a novel alloy with both increased strength and increased hardness is produced. As was referred to in FIG. 1, the addition of carbon and titanium induced the formation of fine carbide particles along refined dendritic boundaries. An optical micrograph of IC-460, shown in FIG. 2(b) in comparison with the base alloy shown in FIG. 2(a), shows the retention in IC-460 of the refined dendritic structures with boundaries decorated with fine carbide particles.

Figure 4A:
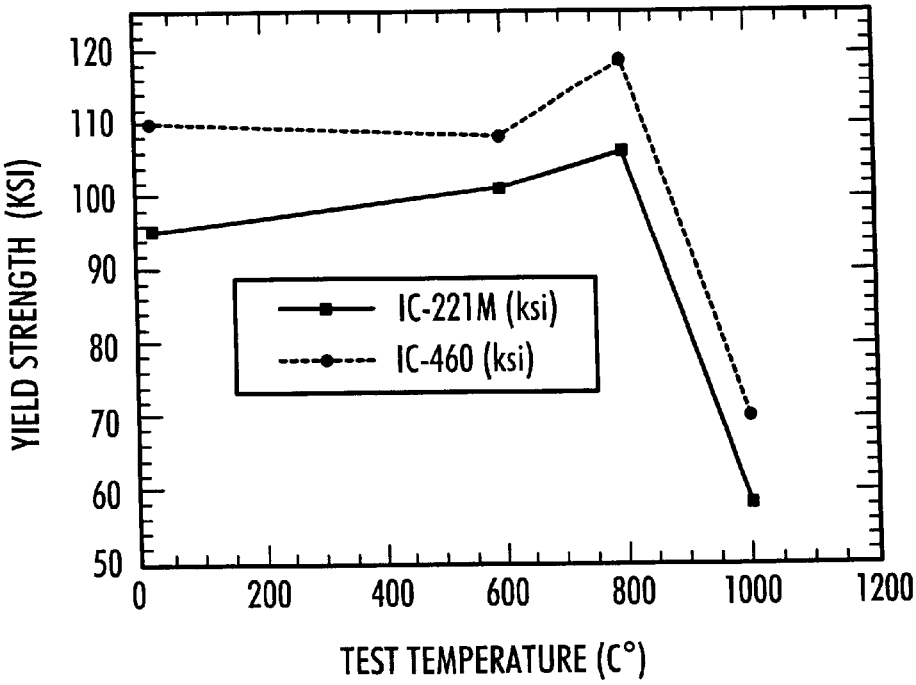
FIG. 4 is a comparison of (a) the yield strength and (b) elongation as functions of temperature for base alloy IC-221M and the alloy of the current invention.
Figure 4B:
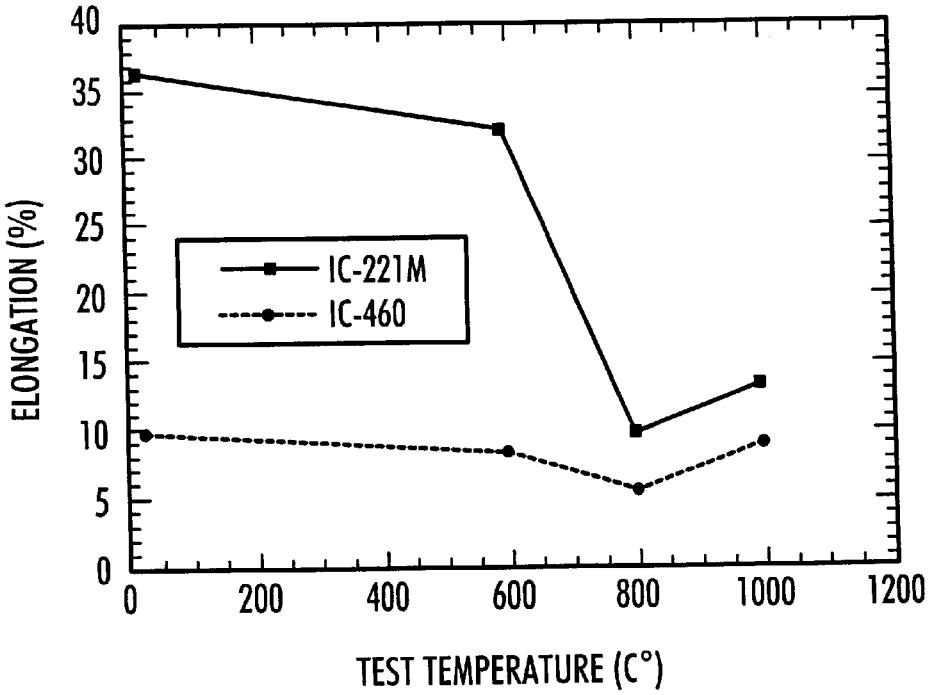

The data plotted in FIG. 4 shows the significant improvements provided by the claimed invention. The top graph (a) shows that, at all temperatures shown, an alloy of the claimed invention has a higher yield strength than the base alloy. The yield strength of IC-460 exceeds that of the base alloy by about 16% at these temperatures. The second (b) graph in FIG. 4 compares elongation as a measure of ductility. While the ductility of IC-460 is lower than that of the base alloy, it averages around 10% at all temperatures. This average is well within the suitable ranges for applications in the tool and die area, as well as in structural applications.

Finally, the measured hardness of IC-460 is about 39.1 $k_c$. This is over about 14% higher than the measured hardness of the base alloy. It is this significantly increased hardness that makes alloys of the claimed invention a novel and superior material for applications such as tool and die works, where high hardness is highly desirable.

The overall composition of the claimed alloys is novel in comparison to the alloys known to the art. Specifically, the increased amounts of molybdenum included and the novel addition of carbon are significant. While the inventors do not intend to be bound by a particular theory, it is believed that the addition of carbon, and the formation of carbides, causes or at least improves the formation of refined dendritic structures. The presence of the fine carbide particles is believed to improve strength and hardness. It is also believed that molybdenum, alone or as molybdenum carbides, contributes to the phenomena of both solution hardening and particle strengthening. The combination of these two improvements provides the novel and improved material.

While it is an object and accomplishment of the invention to provide alloys particularly suited for uses at elevated temperatures of up to about 1000° C., the invention is not so limited. The uses include, but are by no means limited to, hot forging, tool and die operations and components, machining operations and components, and structural elements in engineering systems. Because of the improved hardness and strength, the novel nickel-aluminide of the invention may be used in place of other alloys in applications requiring these increased characteristics. The alloys of the invention show improved properties throughout the range of from about 25 to about 1000° C., and are thus likewise suited for use throughout the range.

Moreover, these improved characteristics are achieved without requiring any special manufacturing processes. Alloys of the claimed invention can be made by any method of forming alloys. While it is preferred to melt the components to form the alloy, such as by arc, induction, or resistance melting either in air or under inert gas, any other process of forming alloys may be used. Also, while it is preferred that the alloy be cast, it can also be machined or formed by any known process.

Some variations are possible to the foregoing described novel materials. These variations do not necessarily depart from the scope and intent of the claimed invention, the scope of which is defined by the following claims.

What is claimed is:

1. $ANi_3Al$-based alloy comprising nickel, aluminum, chromium, molybdenum, zirconium, titanium, carbon, and boron, said alloy having a yield strength of about 110 ksi (767 MPa), an ultimate strength of about 140 ksi (976 MPa), and an elongation of about 10.0% at room temperature (25° C.);

said alloy having a yield strength of about 70.0 ksi (488 MPa), an ultimate strength of about 75.9 ksi (529 MPa), and an elongation of about 9.1% at 1000° C.; and said alloy containing 0.88 to about 2 carbon by atomic percent.

2. A $Ni_3Al$-based alloy also comprising chromium, molybdenum, zirconium, titanium, carbon, and boron, said alloy, in comparison to IC-221M, having about 16% higher strength at temperatures ranging from about 25 to about 1000 degrees C., having a hardness at room temperature about 14% higher than said IC-221M, and wherein said alloy comprises 0.88to about 2 carbon by atomic percent.

3. An alloy comprising, by atomic percent,:

Al: about 15–17;

Cr: about 6–9;

Mo: about 1.5–3.0;

Zr: about 0.2–1;

Ti: about 0.5–1.5;

C: 0.88 to about 2; and

B: about0.01–0.1;

balance Ni.

4. The alloy according to claim 3, wherein said alloy comprises by atomic percent of the alloy:

Al: about 15.6;

Cr: about 8.0;

Zr: about 0.8;

Ti: about 1.0;

C: about 1.7; and

B: about 0.05;

balance Ni.

5. The alloy according to claim 3, wherein said alloy has a yield strength of from about 70.0 ksi (488 MPa) to about 110 ksi (767 MPa) in the temperature range of from about 1000 to about 25 degrees C., an ultimate strength of about 75.9 ksi (529 MPa) to about 140 ksi (976 MPa) in the temperature range of from about 1000 to about 25 degrees C., and a hardness at about 25 degrees C. of about 39.1 $R_c$.

6. A nickel aluminide alloy suitable for use at temperatures up to about 1000° C. in as-cast conditions, said alloy consisting essentially of: a nickel aluminide base; a concentration of carbon and titanium sufficient to cause the formation of a refined dendritic structure having fine carbide particles at the boundary thereof; a concentration of molybdenum sufficient to increase the solution hardness of the alloy; chromium in an amount of from about 6.0 to about 9.0 atomic percent; zirconium in a concentration of from about 0.2 to about 1.0 atomic percent; and boron in a concentration of from about 0.10 to about 0.01 atomic percent.

7. The alloy according to claim 6, wherein said alloy exhibits improved grain boundary and solution strength as compared to IC-221M.

8. The alloy according to claim 6, wherein said carbon is present at a concentration of from about 1.0 to 2.0 atomic percent; said titanium is present at a concentration of from about 0.5 to 1.5 atomic percent; and said molybdenum is present at a concentration of from about 1.5 to about 3.0 atomic percent.

9. The alloy according to claim 3, wherein said alloy comprises by atomic percent of the alloy:

Al: about 15–17;

Cr: about 7–9;

Mo: about 1.5–3.0;

Zr: about0.5–1;

Ti: about 0.5–1.5;

C: 0.88 to about 2;

B: about 0.01–0.1; and balance Ni.

10. The alloy according to claim 3, wherein said alloy comprises by atomic percent of the alloy:

Al: about 15.6;

Cr: about 8;

Mo: about 1.7;

Zr: about 1;

Ti: about 1.1;

C: about 1.7;

B: about 0.015; and balance Ni.

11. The alloy according to claim 3, wherein said alloy comprises by atomic percent of the alloy:

Al: about 15.6;

Cr: about 8;

Mo: about 2.5;

Zr: about 0.8;

Ti: about 1;

C: about 1.25;

B: about0.15;and balance Ni.

* * * * *